US005394221A

United States Patent [19]

Kishimoto et al.

[11] Patent Number: 5,394,221

[45] Date of Patent: Feb. 28, 1995

[54] IMAGE FORMING APPARATUS

[75] Inventors: Yasuhiro Kishimoto; Naoyuki Hashimoto; Hitoshi Hattori, all of Gifu, Japan

[73] Assignee: Sanyo Electric Co., Ltd., Moriguchi, Japan

[21] Appl. No.: 76,398

[22] Filed: Jun. 14, 1993

[30] Foreign Application Priority Data

Jun. 16, 1992 [JP] Japan ..... 4-156476

[51] Int. Cl.[6] ..... G03G 21/00; G03G 15/02

[52] U.S. Cl. ..... 355/208; 355/204; 355/219; 361/225

[58] Field of Search ..... 355/203, 204, 208, 219, 355/215, 214, 228, 232, 221, 67; 361/225

[56] References Cited

U.S. PATENT DOCUMENTS 4,636,060 1/1987 De Schamphelaere et al. ... 355/221
4,963,926 10/1990 Onishi et al. ..... 355/203
4,970,557 11/1990 Masuda et al. ..... 355/208 X
4,974,020 11/1990 Takamatsu et al. ..... 355/208
5,029,314 7/1991 Katsumi et al. ..... 355/208
5,060,017 10/1991 Ueda ..... 355/221
5,160,967 11/1992 Tonegawa ..... 355/208
5,181,070 1/1993 Masuda ..... 355/208 X
5,225,873 7/1993 Lux et al. ..... 355/208
5,253,017 10/1993 Takeda ..... 355/219

*Primary Examiner*—Matthew S. Smith
*Attorney, Agent, or Firm*—Darby & Darby

[57] ABSTRACT

An image forming apparatus includes a microcomputer. The number of image forming operation of a photosensitive drum is counted by a counter as a copy quantity, and data of the copy quantity is applied to the microcomputer. By referring to a copy quantity-voltage table, voltage setting data according to the copy quantity is applied by the microcomputer to a bias voltage source so that the bias voltage source applies a required bias voltage according to the voltage setting data to a conductive substrate of the photosensitive drum.

11 Claims, 5 Drawing Sheets

IMAGE FORMING APPARATUS

BACKGROUND OF THE INVENTION

1. Field of the invention

The present invention relates to an image forming apparatus. More specifically, the present invention relates to an image forming apparatus such as a copying machine, printer, facsimile and etc. in which a photosensitive member is exposed with a light image to form an electrostatic latent image which is then developed by a toner.

2. Description of the Prior Art

In a kind of an electrophotographic apparatus, electrophotographic processes such as charging, exposure, developing, transferring, separating, cleaning, erasing, and etc. are repeated around a photosensitive drum. Not only does the sensitivity of the photosensitive drum become low but also a residual voltage (Vr) increases due to (1) fatigue of the photosensitive drum by an exposure light and an erasing light, (2) deterioration of a photosensitive layer by ozone which is generated in charging, transferring and separating, (3) decrease of the thickness of the photosensitive layer by friction with a cleaning blade, and etc. Resultingly, a voltage of a portion corresponding to a white ground of an original, that is, an exposure voltage (VL) which was approximately equal to zero in an initial state increases. Therefore, a so-called fogging phenomenon occurs, and accordingly, the life of the photosensitive member decreases.

Therefore, in the past, it was known to use an electrophotographic apparatus in which a developing bias voltage (Vb) is increased for prolonging the life of the photosensitive member (Japanese Patent Application Laying-Open No. 50-46334), and an electrophotographic apparatus in which the amount of light from the exposure lamp is increased for prolonging the life of the photosensitive member.

In the former apparatus, there was a problem that the image density is lowered because a voltage difference between a dark voltage (Vd) corresponding to a black portion of the original and the developing bias voltage (Vb) becomes small. On the other hand, in the latter apparatus, it was impossible to deal with the increase of the exposure voltage (VL) according to the increase of the residual voltage (Vr), and therefore, the latter apparatus had its limit.

SUMMARY OF THE INVENTION

Therefore, a principal object of the present invention is to provide a novel image forming apparatus.

Another object of the present invention is to provide an image forming apparatus in which it is possible to prolong the life of a photosensitive member without the problem that the image density becomes thin.

An image forming apparatus according to the present invention comprises a photosensitive member including a conductive substrate; exposing means for exposing the photosensitive member; detecting means for detecting the number of use times, that is, the image forming operations, of the photosensitive member; and changing means for changing an electric potential of the conductive substrate in response to an output of the detecting means.

By utilizing the fact that an exposure voltage is increased with increase of a copy quantity, for example, a relationship between the copy quantity and an electric potential of the conductive substrate is stored in advance in the ROM of a microcomputer as a copy quantity-voltage table. The number of image forming operations of the photosensitive member, that is, the copy quantity is detected by the detecting means such as a counter, and voltage data corresponding to a detected copy quantity is read-out from the table, and in accordance with the voltage data, a bias voltage source is controlled by a microcomputer, for example. Therefore, the electric potential of the conductive substrate is changed according to the copy quantity, that is, the number of use times of the photosensitive member. Accordingly, the exposure voltage is suppressed from increasing.

In accordance with the present invention, since the exposure voltage is prevented from increasing by changing the electric potential of the conductive substrate, it is possible to prolong the life of the photosensitive member without a problem that the image density is lowered.

In addition, if an exposure light amount is also changed, an increasing range of a bias voltage which is applied to the conductive substrate can be made small, and therefore, it is possible to further prolong the life of the photosensitive member.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
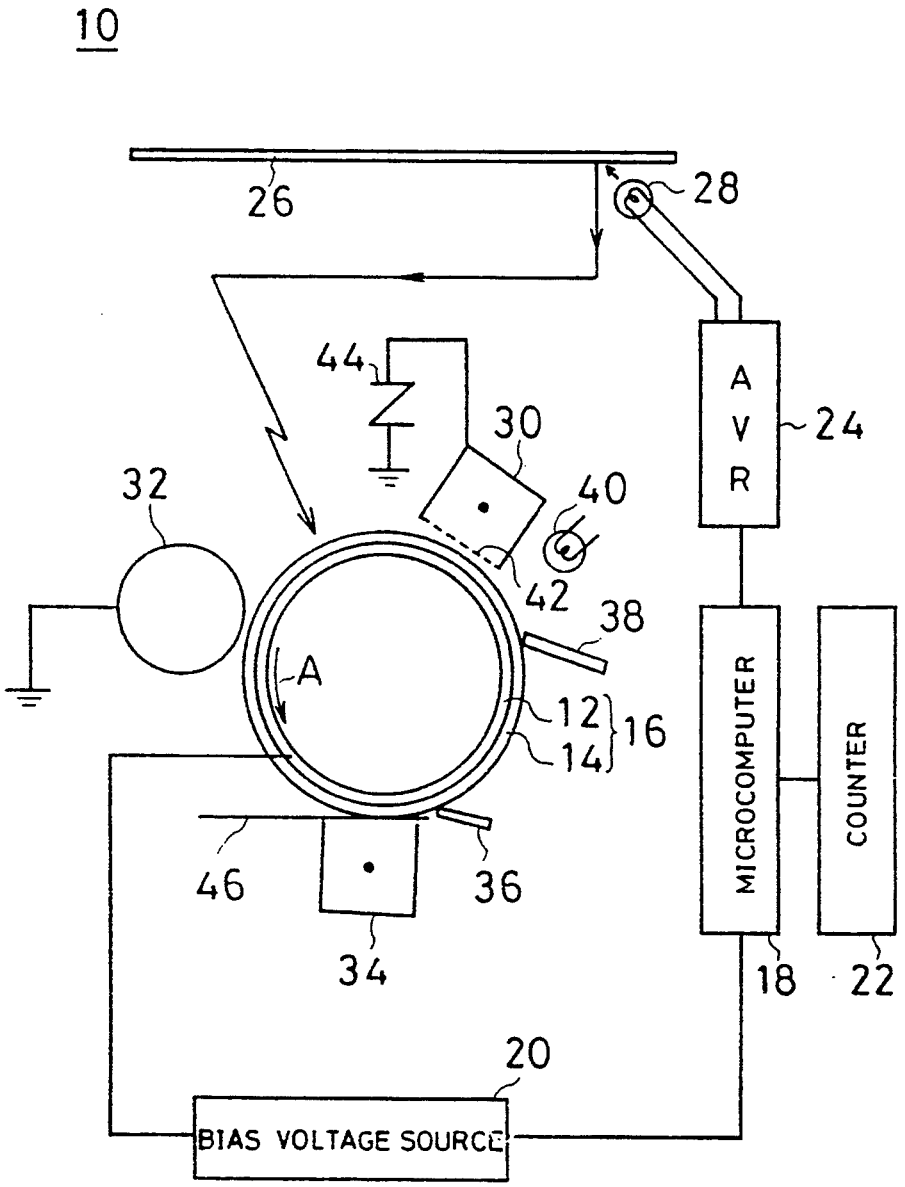
FIG. 1 is an illustrative view showing one embodiment according to the present invention.

Referring to FIG. 1, an electrophotographic apparatus 10 of this embodiment includes a negative polarity photosensitive drum 16 having a conductive substrate 12 made of a metal, for example, and a photosensitive layer 14 which is made of polyvinyl carbazole, for example, and formed on a surface of the conductive substrate 12. However, instead of the photosensitive drum 16, another type of photosensitive member such as a photosensitive belt, photosensitive plate and etc. may be utilized. An output terminal (not shown) of a bias voltage source 20 which is controlled by a microcomputer 18 is connected to the conductive substrate 12. The microcomputer 18 receives as an input the output of a counter 22 which counts a copy quantity, that is, the number of use times of the photosensitive drum 16. The microcomputer 18 also controls an AVR (Automatic Voltage Regulator) 24 which functions as an electric power source for driving a light source 28 which exposes an original (not shown) put on an original table 26. A relationship between the copy quantity and a required bias voltage is stored in a ROM (not shown) of the microcomputer 18 as a copy quantity-voltage table. In addition, a relationship between the copy quantity and a required exposure light amount is also stored in the ROM as a copy quantity-light amount table.

Arranged around the photosensitive drum 16, is a charger 30, an exposure unit (not shown), a developer 32, a transferer 34, a separating claw 36, a cleaning blade 38, an erasing lamp 40, and other necessary components.

The charger 30 includes a mesh-like grid electrode 42 which is connected to ground through a varistor 44 which functions as a bi-directional constant voltage diode. The varistor voltage is set as −400 volts, and therefore, the surface voltage of the photosensitive drum 16 is controlled at −400 volts.

When an original image is irradiated onto the photosensitive drum 16 which has been charged by the charger 30 by the exposure unit (not shown) including a short focal distance lens array or the like, an electrostatic latent image is formed on the photosensitive drum 16 in accordance with a photosensitive characteristic of the photosensitive drum 16. As well known, the developer 32 includes a toner box, a magnetic brush, and etc. By agitating a carrier having a negative charging characteristic and a toner in the toner box, the toner is charged with a positive polarity. The toner is adhered to the electrostatic latent image which is formed with a negative polarity charge, and therefore, the electrostatic latent image is toner-developed. In addition, the magnetic brush (not shown) of the developer 32 is connected to ground such that the developing bias voltage (Vb) can be set as 0 volts.

The transferer 34 transfers a toner image formed on the photosensitive drum 16 to a paper sheet 46 which is fed from a left side of FIG. 1. More specifically, when a direct-current corona discharging of a negative polarity is applied to the paper 46 from a back surface thereof by the transferer 34, the toner which has formed the toner image on the photosensitive drum 16 is attracted by an electric field of the transferer 34 so as to be transferred onto the paper 46. The paper 46 onto which the toner image has been transferred is separated from the photosensitive drum 16 by the separating claw 36. The paper 46 is then fed toward a fixing unit (not shown), and the toner image is fixed to the paper 46 which is then discharged.

After the toner image is transferred from the photosensitive drum 16 to the paper 46, the cleaning blade 38 removes a toner and paper powder remaining on the photosensitive drum, and the erasing lamp 40 eliminates a residual charge of the photosensitive drum 16.

A single copy is thus completed by charging, exposure, developing, transferring, separating, cleaning and charge erasing. Each completed copy is counted by the counter 22. The output of the counter 22, that is, the copy quantity, is applied to the microcomputer 18.

Then, by referring to the stored copy quantity-voltage table (not shown), the voltage setting data according to the copy quantity is read-out by the microcomputer 18 which applies the data to the bias voltage source 20 so that a bias voltage from the bias voltage source 20 is controlled by the voltage setting data. Thus, the bias voltage (Vpc) according to the voltage setting data is applied to the conductive substrate 12.

Furthermore, with referring to the stored copy quantity-light amount table (not shown), the light amount setting data according to the copy quantity is read-out by the microcomputer 18 which then applies the data to the AVR 24 so that the driving voltage for the light source 28, that is, the light amount is adjusted in accordance with the light amount setting data.

Figure 2:
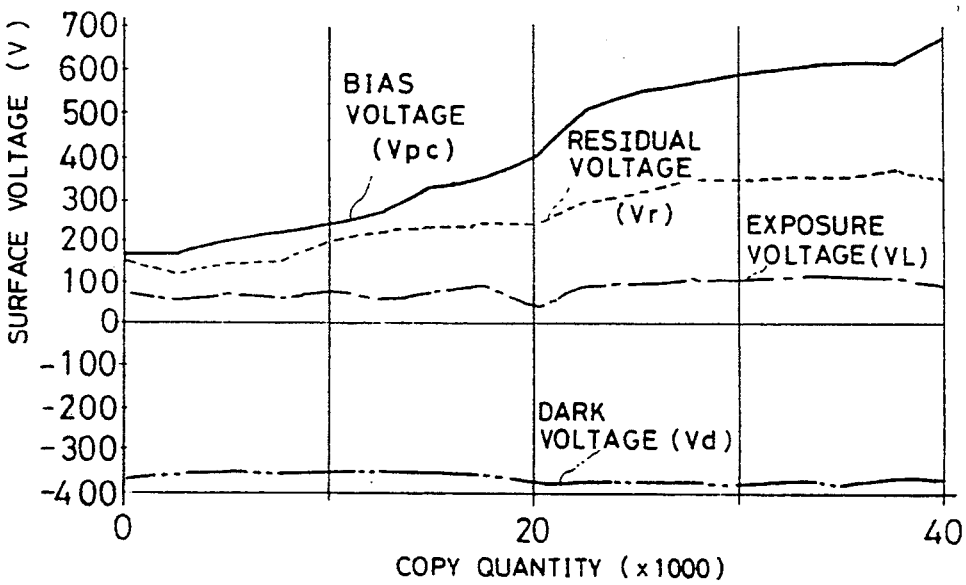
FIG. 2 is a graph showing changes of a bias voltage and a surface voltage of a photosensitive drum.

FIG. 2 is a graph showing a change of the surface voltage of the photosensitive drum 16 in a case where the exposure light amount is kept constant while the bias voltage (Vpc) is changed in accordance with the copy quantity. As shown in the graph, by changing the bias voltage (Vpc) according to the copy quantity, it is possible to keep the exposure voltage (VL) approximately constant, and therefore, a good image without fogging can be obtained for a long time. Therefore, the life of the photosensitive drum 16 can be prolonged.

Figure 3:
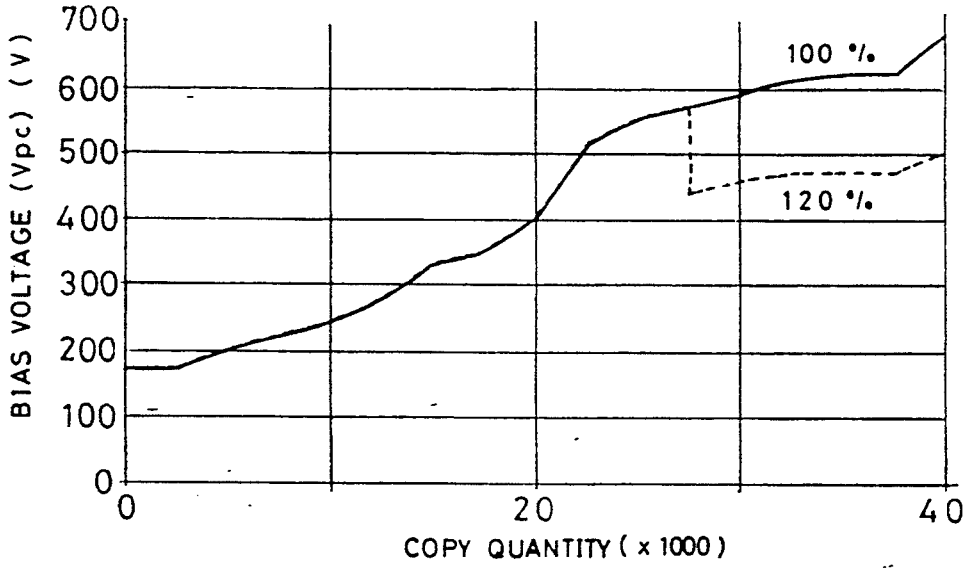
FIG. 3 is a graph showing a change of the bias voltage when an exposure light amount is increased.

As shown in a graph of FIG. 3, if the exposure light amount as well as the bias voltage (Vpc) are simultaneously changed, the increase range of the required bias voltage (Vpc) can be reduced, and therefore, it is possible to further prolong the life of the photosensitive drum 16. In a case where the bias voltage source having an output voltage with an upper limit of the 600 volts, for example, is used, if the light amount is constant at 100%, it is seen that the fogging phenomenon occurs at the copy quantity of approximately 30,000; however, by increasing the light amount by 120%, it is possible to delay the time that the fogging phenomenon occurs, and therefore, the life of the photosensitive drum 16 can be prolonged.

Figure 4:
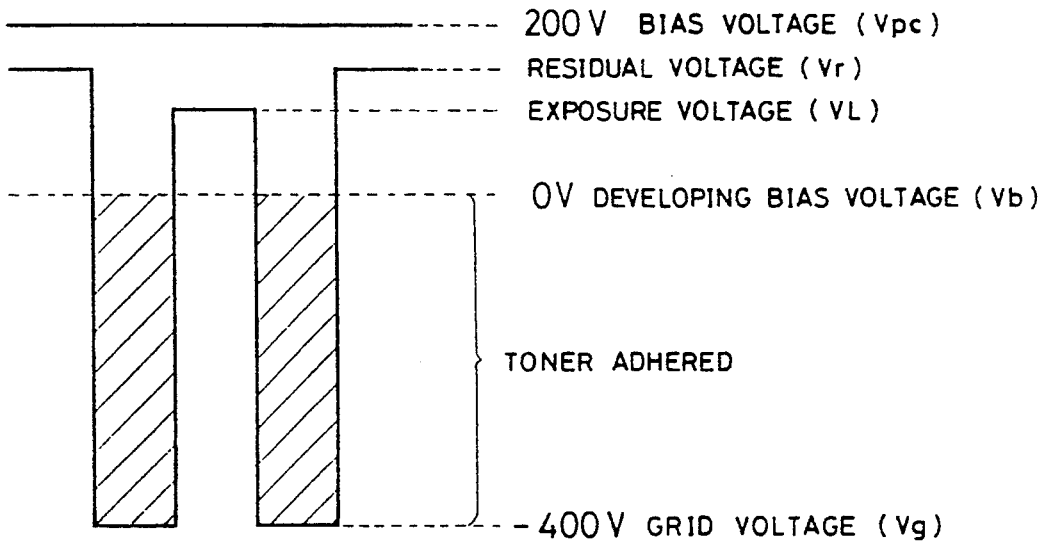
FIG. 4 is a graph showing a surface voltage model of the photosensitive drum.

FIG. 4 is a graph showing a model of the surface voltage of the photosensitive drum 16 in a case where a bias voltage (Vpc) of 200 volts is applied to the conductive substrate 12 in the above described embodiment.

Figure 5:
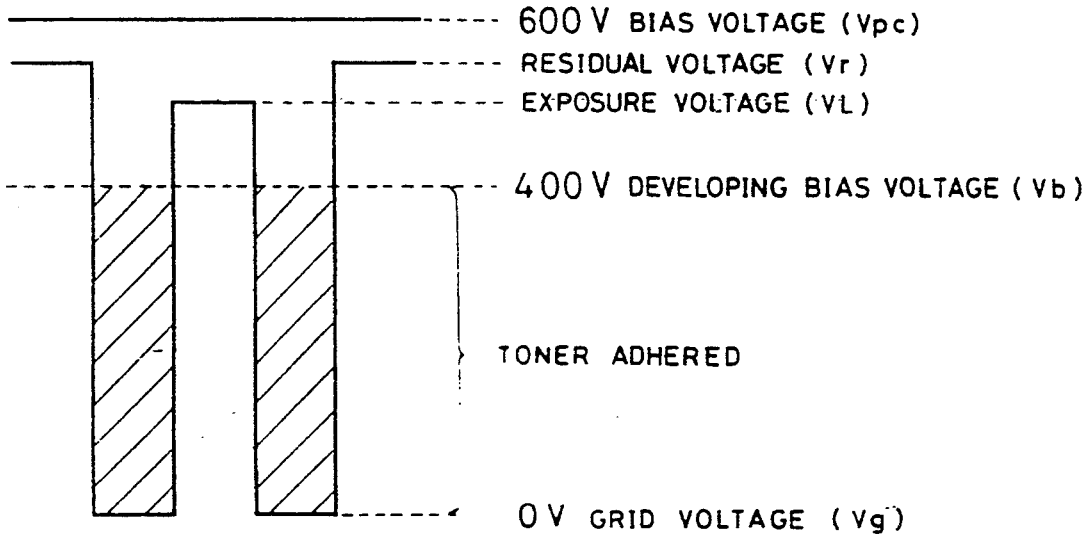
FIG. 5 is a graph showing the surface voltage model when a voltage level is shifted.

In addition, in the above described embodiment, although the grid electrode 42 of the charger 30 is connected to ground through the varistor 44, it is possible to consider that the grid electrode 42 is directly connected to ground and each of the developing bias voltage (Vb) and the bias voltage (Vpc) is increased by 400 volts. In this case, a model of the surface voltage of the photosensitive drum 16 becomes the same as the model of the surface voltage of the above described embodiment (FIG. 4), as shown in FIG. 5.

Figure 6:
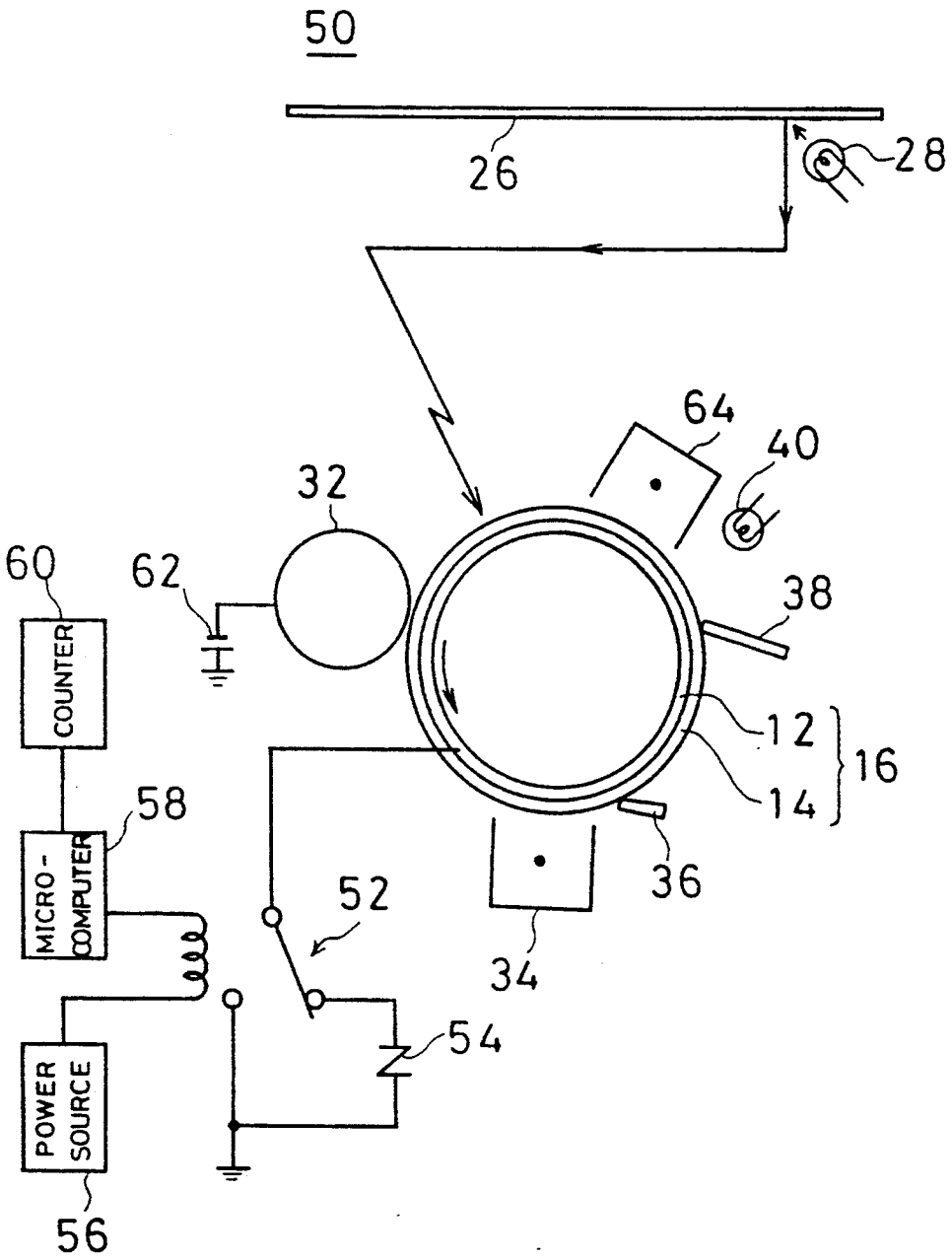
FIG. 6 is an illustrative view showing another embodiment according to the present invention.

In an electrophotographic apparatus 50 according to another embodiment, as shown in FIG. 6, a relay 52 is connected to the conductive substrate 12 of the photosensitive drum 16. Switching the relay 52 selects a state where the conductive substrate 12 is directly connected to the ground or a state where the same is connected to the ground through the varistor 54 having the varistor voltage of 50 volts. The relay 52 is driven by a driving power source 56 which is controlled by a microcomputer 58. The microcomputer 58 receives an output of a counter 60 for counting the copy quantity. The developing bias voltage (Vb) of approximately −250 volts is applied to the magnetic brush (not shown) of the developer 32 by a developing bias voltage source 62. In addition, the charger 46 of this embodiment may be the same as the charger 30 of FIG. 1 or the charger 46 may be one having no grid electrode.

Figure 7:
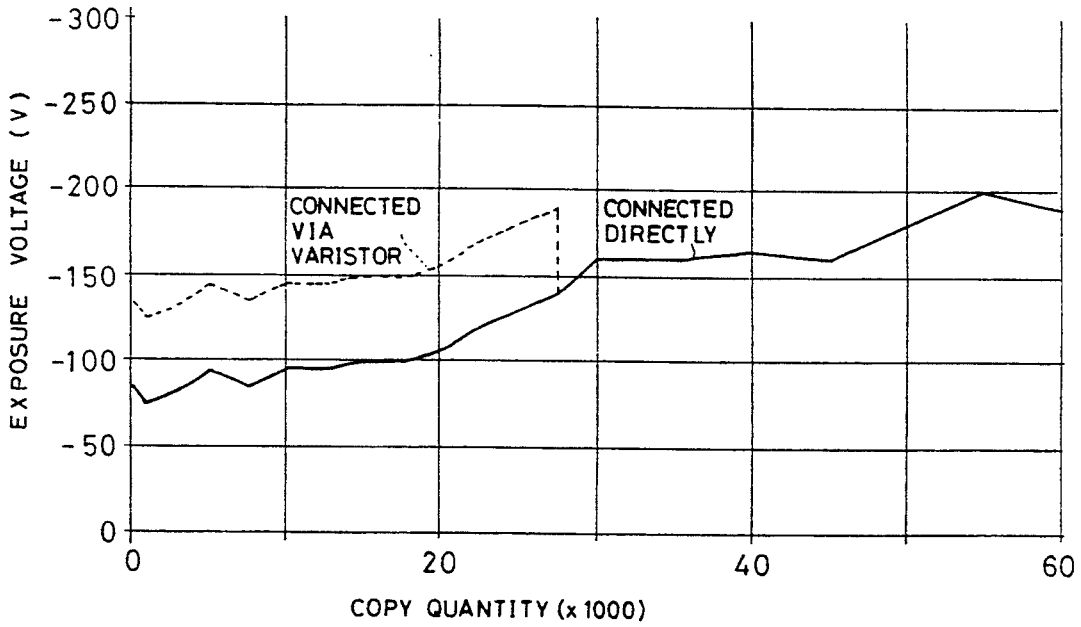
FIG. 7 is a graph showing a change of an exposure voltage in FIG. 6 embodiment.

In operation, the number of use times of the photosensitive drum 16 is counted by the counter 60 as the copy quantity. The output of the counter 60, that is, the copy quantity, is applied to the microcomputer 58. The microcomputer 58 determines whether or not the copy quantity is less than 27,500, for example, and in response to such determination, the relay 52 is switched by the microcomputer 58. More specifically, if it is determined that the copy quantity is less than 27,500, the conductive substrate 12 is connected to ground through the varistor 54 by the relay 52. On the other hand, when it is determined that the copy quantity is more than 27,500, the conductive substrate 12 is directly connected to the ground by the relay 52. Therefore, if the copy quantity is less than 27,500, the exposure voltage (VL) of the photosensitive drum 16 is changed as shown by a dotted line in FIG. 7. The exposure voltage (VL) of this case is higher than that of the case where the conductive substrate 12 is directly connected to ground (a solid line in FIG. 7) by approximately 50 volts. If the relay 52 is not switched to a state where the conductive substrate 12 is directly connected to the ground (the solid line in FIG. 7), the voltage difference between the exposure voltage (VL) and the developing bias voltage (Vb) becomes too large in a period that the copy quantity is small, and therefore, there is the possibility that a so-called carrier attracting phenomenon where the carrier within the developer 32 is adhered to the photosensitive drum 16, and thus, the photosensitive drum 16 is damaged.

However, in accordance with the embodiment shown in FIG. 6, since the developing bias voltage (Vb) applied to the magnetic brush of the developer 32 is set to be approximately "−250 volts", even if the exposure voltage (VL) is increased by −200 volts, no fogging phenomenon occurs.

In addition, in the embodiment shown in FIG. 6, only a single varistor 54 is provided for defining the voltage of the conductive substrate 12; however, a plurality of varistors having different varistor voltages may be provided and the varistors may be switched by a relay. Furthermore, instead of the varistor(s), a resistor(s) may be utilized. In this case, a voltage is developed on the resistor in accordance with a resistance value thereof by a current flowing the photosensitive layer 14, and therefore, an advantage similar to that of the varistor can be obtained.

Furthermore, in the embodiments shown in FIG. 1 and FIG. 6, the bias voltage (Vpc) is set for the photosensitive drum 16 on the basis of the output of the counter 22 (or 60) for counting the copy quantity. However, in such a kind of image forming apparatus, papers having different sizes as such a letter size and a legal size are usually utilized. In the image forming apparatus capable of using papers of different sizes, on the basis of a paper having a specific size and a feeding direction of the paper, the copy quantity-voltage table, the copy quantity-exposure light amount table, the value of the copy quantity at that the relay is switched, and so on may be stored in the ROM. Then, if an exposure length to the photosensitive drum according to a relationship of a used paper and a feeding direction thereof becomes different from the above described standard stored in the ROM. By providing a correcting means for correcting a counted value of the counter 22 (or 60), it becomes possible to surely set the bias voltage (Vpc). For example, if the above described standard is stored in a state where the paper is the letter size and the feeding direction thereof is a longitudinal direction, when a paper of a legal size is fed in a longitudinal direction, the correcting means corrects the copy quantity, that is, the counted value of the counter by 1.3 times that is equal to a ratio of the length. The counted value of 1.3 times is added to the total copy quantity which is used as the number of use times of the photosensitive drum 16. However, if the standard is stored in a state where a paper is letter size and the feeding direction thereof is in a lateral direction, even if a paper of legal size is used in a feeding direction of a lateral direction thereof, the exposure length to the photosensitive drum 16 becomes equal to that of the standard, it is not necessary to correct the counted value, that is, the copy quantity. That is, the correcting means corrects the copy quantity only when the exposure length that is relevant to the life of the photosensitive member is different from the exposure length of the standard stored in the ROM.

In addition, in the above described embodiments, the electrophotographic apparatus 10 or 50 is used as a copying machine; however, an image forming apparatus to which the present invention can be applied may be a printer, a facsimile, and etc. In such a case, an LED array, laser beam or the like can be used as the exposing means.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

a photosensitive member including a conductive substrate;

means for repetitively exposing said photosensitive member to light and an original for repetitive image forming operations;

means for detecting the number of image forming operations of said photosensitive member; and means for changing an electric potential of said conductive substrate in response to an output of said detecting means corresponding to the detected number of image forming operations of said photosensitive member.

2. An image forming apparatus according to claim 1, wherein said electric potential changing means includes a bias voltage source for applying a bias voltage to said conductive substrate; and voltage control means for controlling an output voltage of said bias voltage source.

3. An image forming apparatus according to claim 2, further comprising means for controlling a light amount of said exposing means in response to the output of said detecting means.

4. An image forming apparatus according to claim 1, wherein said electric potential changing means includes a plurality of voltage defining means each for defining a voltage of said conductive substrate at respectively different values each corresponding to a predetermined detected number of image forming operations, and means for selecting one of said plurality of voltage defining means in response to the output of said detecting means.

5. An image forming apparatus according to claim 4, wherein said electric potential changing means includes a voltage source having a ground and at least one of its said voltage defining means includes a varistor having one end connected to said conductive substrate and other end connected to the ground.

6. An image forming apparatus according to claim 5, wherein said electric potential changing means includes a voltage source having a ground and one of its said voltage defining means includes grounding means for directly connecting said conductive substrate to the ground.

7. An image forming apparatus according to claim 4, wherein said electric potential changing means includes a voltage source having a ground and at least one of its said voltage defining means includes a resistance device having one end connected said conductive substrate and other end connected to the ground.

8. An image forming apparatus according to claim 7, wherein said electric potential changing means includes a voltage source having a ground and one of its said voltage defining means includes grounding means for directly connecting said conductive substrate to the ground.

9. An image forming apparatus according to claim 4, further comprising means for controlling a light amount of said exposing means in response to the output of said detecting means.

10. An image forming apparatus according to claim 1, further comprising means for controlling a light amount of said exposing means in response to the output of said detecting means.

11. An image forming apparatus comprising:

a photosensitive member including a conductive substrate;

means for repetitively exposing said photosensitive member for repetitive image forming operations;

means for detecting the number of image forming operations of said photosensitive member;

means for correcting the number of image forming operations attributed to said photosensitive member on the basis of an exposure time which is different from a standard exposure time; and means for changing an electric potential of said conductive substrate in response to an output of said detecting means corresponding to the detected number of image forming operations of said photosensitive member.

* * * * *